United States Patent [19]

Manizza

[11] 4,244,617

[45] Jan. 13, 1981

[54] BOTTLE CARRIER

[75] Inventor: Guelfo A. Manizza, Blauvelt, N.Y.

[73] Assignee: Federal Paper Board Company, Inc., Montvale, N.J.

[21] Appl. No.: 1,921

[22] Filed: Jan. 8, 1979

[51] Int. Cl.[3] ..... B65D 71/00

[52] U.S. Cl. ..... 294/87.2; 206/153; 206/199

[58] Field of Search ..... 294/87 R, 87.2, 87.28; 206/139, 141, 145, 152, 147–149, 153, 158, 162, 170, 175, 199, 427; 215/100 A; 224/45 A, 45 AA, 45 AB, 45 BA

[56] References Cited

U.S. PATENT DOCUMENTS

| | | | |
|---|---|---|---|
| 1,910,168 | 5/1933 | Jacobs | 224/45 BA X |
| 2,965,410 | 12/1960 | Hughes | 294/87.2 |
| 3,016,259 | 1/1962 | Lawrence | 294/87.2 |
| 3,493,261 | 2/1970 | Funkhouser et al. | 294/87.2 |
| 3,561,594 | 2/1971 | Jorgensen | 206/162 X |
| 3,815,947 | 6/1974 | Olsen | 294/87.2 |
| 3,860,281 | 1/1975 | Wood | 294/87.2 |

FOREIGN PATENT DOCUMENTS

| | | | |
|---|---|---|---|
| 2233306 | 1/1973 | Fed. Rep. of Germany | 206/199 |

*Primary Examiner*—Johnny D. Cherry
*Attorney, Agent, or Firm*—Guy A. Greenawalt

[57] ABSTRACT

A packaging arrangement which is especially adapted for marketing bottled beverages wherein a package is formed by securing on the top portions of a plurality of bottles in row arrangement a carrier device formed by folding a cut and scored blank of paperboard, or similar material, into a tube with a triangular cross section, which device is secured on the bottle tops by engaging the neck of each bottle in a position defining aperture in the base forming bottom panel of the device and placing downwardly directed side portions of a flange formation adjacent the top of each bottle in engagement with upwardly facing edge formations defining the lower extremities of oppositely disposed apertures in the associated upwardly converging sidewall forming panels of the tube, with the tube, in several forms thereof, having a double ply handle upstanding from the juncture of the sidewall panels and also in several forms thereof having foldable panels providing more than a single ply of material at the bottle engaging edge formations of the apertures in the sidewall panels.

13 Claims, 23 Drawing Figures

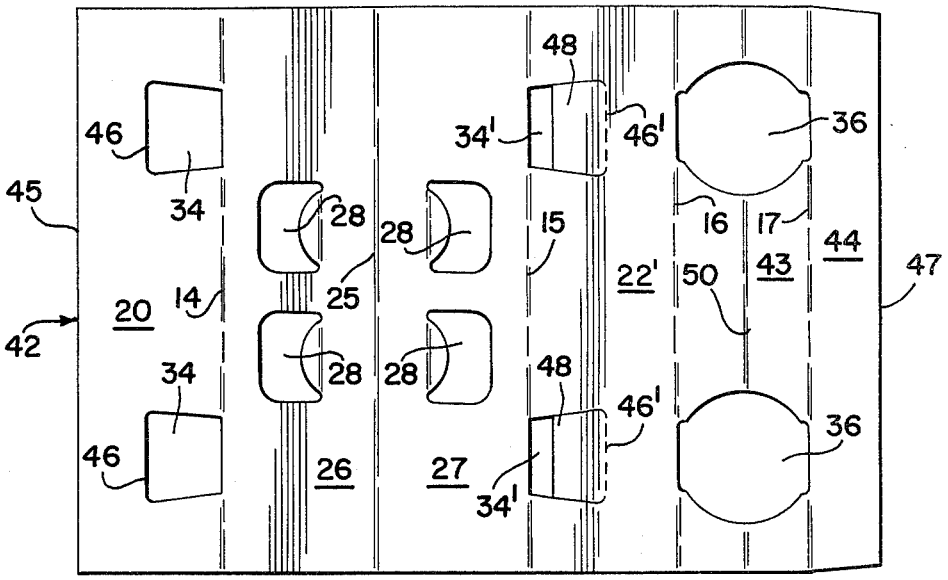
FIG. 5
FIG. 6
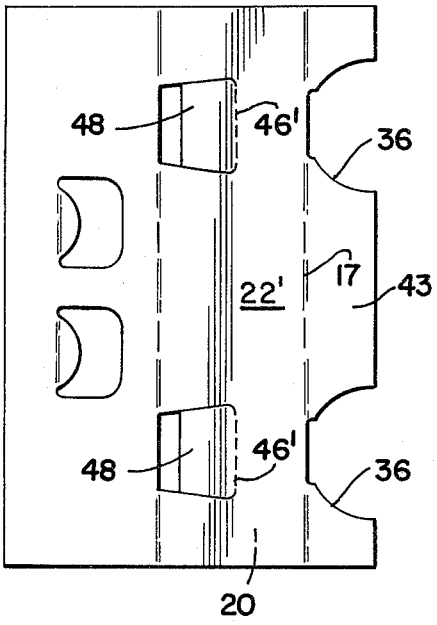
FIG. 7
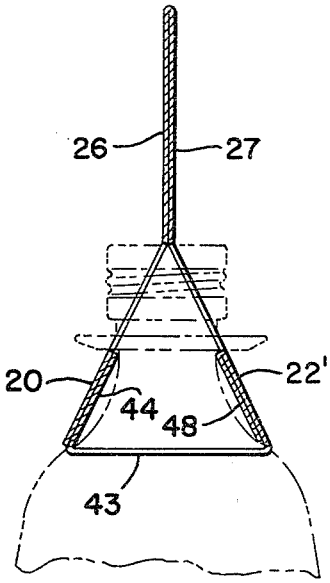

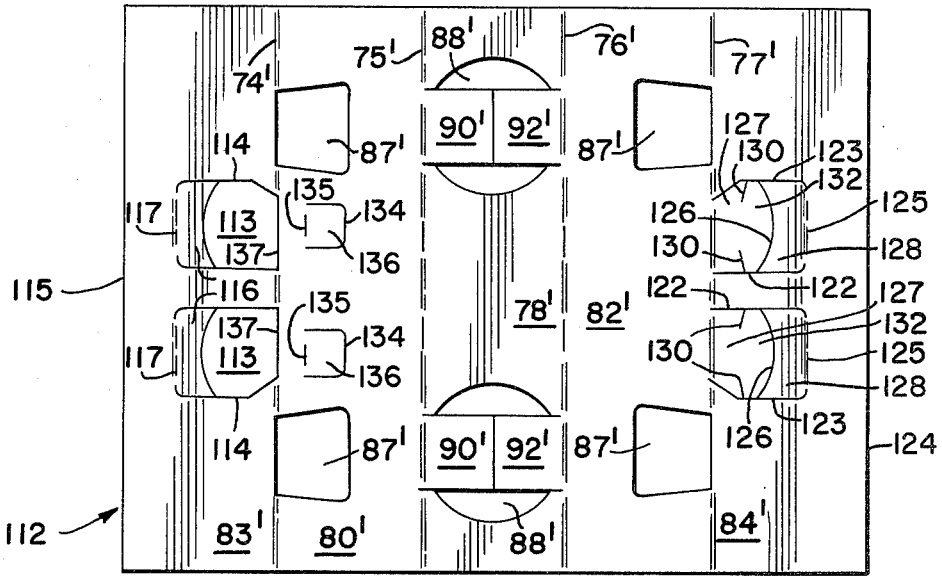
FIG. 12
FIG. 13
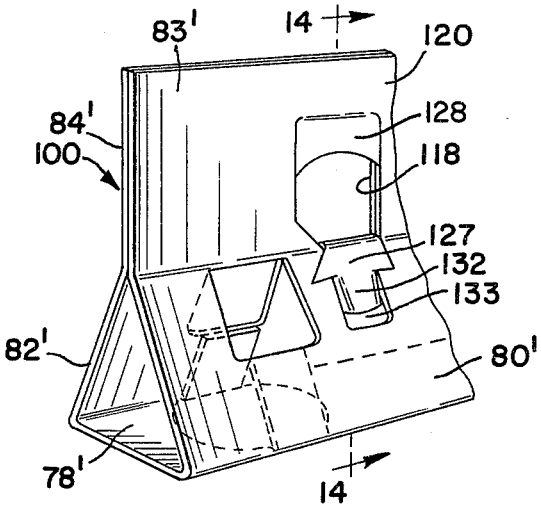
FIG. 14
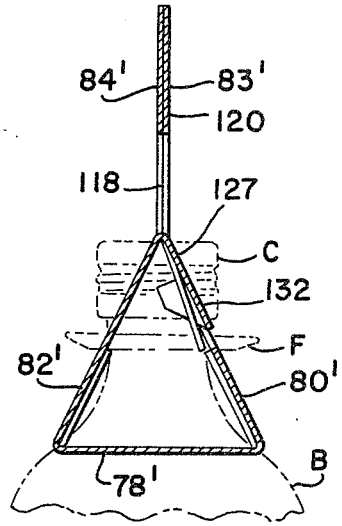

BOTTLE CARRIER

BACKGROUND OF THE INVENTION

This invention relates to packaging and is more particularly concerned with improvements in the packaging of bottled beverages, or other articles having a bottle-like configuration, wherein the package is formed by securing a carrier formed from a folded blank of paperboard or similar sheet material, on the top portion of a group of the articles which have a flange or other downwardly facing abutment forming means adjacent the top which may be utilized to engage oppositely disposed upwardly facing edge portions of sidewall formations of the carrier so that the weight of the articles is carried by the sidewall formations.

In the packaging of bottled products, such as beer and other beverages, particularly, consumer packages of multiple units arranged in row relation, carriers formed of foldable sheet material, such as paperboard, have been devised, heretofore, in which the bottles are supported by engaging skirt portions of the closure caps, or a projecting annular bead adjacent the mouth of each bottle, with upwardly facing edge portions in oppositely disposed sidewall elements of the carrier device. This type package has the advantage of economy in the use of materials, storage space, and generally, in ease of application to the bottle group. However, this type of carrier has not been fully acceptable for a number of reasons. One difficulty encountered has been an inability to provide a satisfactory design which will prevent damaging contact between the bottles and which is sufficiently rugged and damage free, particularly, for group packaging of the more recently introduced jumbo size bottles which are quite heavy when filled with the liquid product. Consequently, there has been a need for a packaging arrangement of this type which is more rugged and more dependable than theretofore provided and which can be produced with maximum economy in the use of materials.

It is a general object of the invention to provide an improved bottle carrier of the top gripping type which may be formed from a single sheet of foldable paperboard, or similar material, with maximum economy of materials and with provision for securely gripping the bottles at the top thereof and for holding them in vertical position with their vertical axes in generally parallel relation.

A more specific object of the invention is to provide an improved bottle carrying package assembly wherein a top gripping and carrying device is formed from sheet material folded into a tube of substantially triangular cross section with a bottom forming wall panel having spaced apertures of a size to snugly engage around the bottle necks at a substantial distance below the tops of the bottles and a pair of upwardly converging sidewall forming panels which have transversely aligned apertures in vertical alignment with the apertures in the bottom wall forming panel, which sidewall apertures are defined in part by upwardly facing edge formations positioned to engage beneath oppositely disposed portions of an annular flange formation or similar abutment forming means adjacent the top of the bottle.

A further object of the invention is to provide a bottle top gripping and carrying device of the type described wherein the sidewall panels extend upwardly to a pair of upwardly extending handle forming panels.

Another object of the invention is to provide a bottle top gripping and carrying device of the type described wherein the bottom edge portions of the apertures in the sidewall are reinforced so as to provide a multiple thickness of the panel material in the wall area below the edges of the apertures which are engaged by the downwardly facing abutment formation adjacent the mouth of the bottle and which bear the weight of the bottle.

Still another object of the invention is to provide a bottle top gripping and carrying device of the type described wherein the bottom edge portions of the apertures in the sidewall panels are reinforced by double plies of the material which may be obtained by forming hinged tabs in areas of the material which would otherwise be cut out and discarded.

A further object of the invention is to provide a bottle top gripping and carrying device wherein bottle gripping apertures in one of the sidewall panels are reinforced by securing to the inside face of the sidewall panel a narrow end panel on the blank which also serves to form the connection between the bottom wall panel and the sidewall panel when the blank is formed into the tubular configuration.

A still further object of the invention is to provide a bottle top gripping and carrying device of the character described which may be initially formed, at least in part, in a fully collapsed and flattened condition.

Another object of the invention is to provide a bottle carrying device of the type described wherein upwardly converging sidewall panels merge at their top connection with a double ply handle formation.

An additional object of the invention is to provide an improved article packaging arrangement wherein articles having the general form of bottles are adapted to be packaged by attaching thereto a top gripping carrier device which is formed from a cut and scored blank of foldable sheet material and which may be initially formed in partially folded condition enabling it to be set up into a tube with a generally triangular cross section and having a bottom wall with one or more bottle neck receiving apertures and sidewalls with bottle top gripping apertures, the bottom edges of which are disposed for engaging an abutment adjacent the bottle mouth and which are reinforced by foldable panel portions, one of which may constitute a portion of a wall connecting panel.

To this end, the invention as claimed herein is embodied in a carrier device for articles having a bottle configuration, which device is formed from paperboard, or other foldable sheet or web material, cut and scored so as to enable it to be formed into a tube of generally triangular cross section with a bottom forming wall apertured to engage over the neck forming portions of the articles and with adjoining sidewalls which are apertured so as to engage in gripping and supporting relation beneath downwardly facing portions of an abutment formation at the top of the articles and in spaced relation above the bottom forming wall.

The aforesaid objects and other objects and advantages of the invention will become more apparent when reference is made to the accompanying detailed description of the preferred embodiment of the invention and the several modifications thereof which are set forth therein, by way of example, and shown in the accompanying drawings wherein like reference numerals indicate corresponding parts throughout.

BRIEF DESCRIPTION OF THE DRAWINGS

FIG. 5 is a plan view of a blank which is modified so as to enable the carrier to be supplied in fully assembled and fully collapsed condition;

FIG. 6 is a plan view of the carrier which is formed from the blank of FIG. 5, in collapsed condition;

FIG. 7 is a cross-sectional view of the carrier of FIG. 6, with the view being taken on a transverse plane corresponding to that of FIG. 2;

FIG. 12 is a plan view of a blank which is cut and scored preparatory to forming of a carrier similar to the carrier of FIGS. 10 and 11 with the addition of a handle panel locking feature;

FIG. 13 is a perspective view of a portion of a carrier formed with the blank of FIG. 12;

FIG. 14 is a cross-sectional view taken on the line 14—14 of FIG. 13;

DESCRIPTION OF THE PREFERRED EMBODIMENTS OF THE INVENTION

Figure 1:
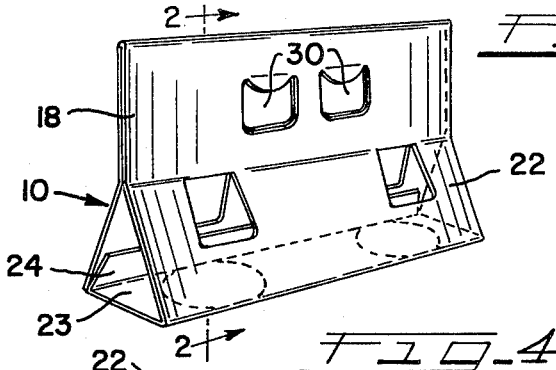
FIG. 1 is a perspective view of a carrier for a pair of beverage bottles which embodies the principles of the invention.

Referring to the drawings there is illustrated a carrier device for a pair of beverage bottles, which may be the large, soft drink bottles recently introduced, which in filled condition, have substantial weight. The illustrated forms of the carrier are particularly adapted to be fabricated by cutting and scoring a sheet or web of paperboard of the weight commonly employed in basket type and wraparound carrier packages for marketing bottled products.

Figure 2:
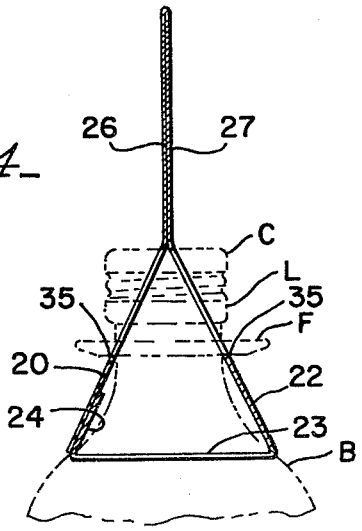
FIG. 2 is a cross-sectional view to an enlarged scale, the view being taken in the line 2—2 of FIG. 1.
Figure 3:
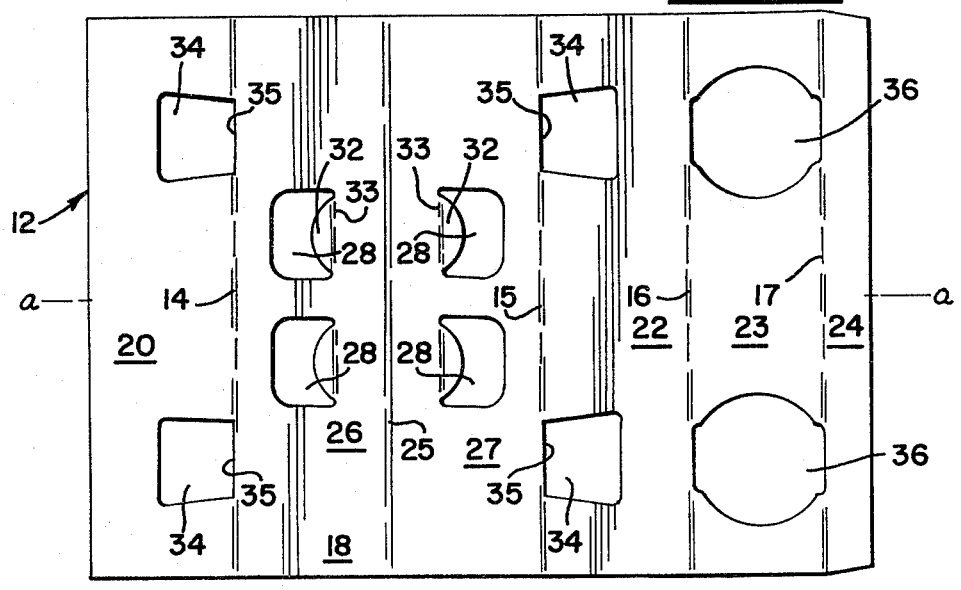
FIG. 3 is a plan view of a cut and scored blank for forming the bottle carrier of FIG. 1.

In the form of the carrier 10 which is illustrated in FIGS. 1 to 3, a generally rectangular blank 12 of paperboard, or other suitable sheet material, of a gauge or weight sufficient to provide the desired strength, is cut and scored or creased, as shown in FIG. 3, to provide the bottle receiving aperture formations and panel folding hinge lines which enable fabrication of the carrier and its application to a pair of bottles. Longitudinally spaced, parallel, transverse score or crease lines 14, 15, 16, and 17 divide the blank 12 into a series of integrally connected rectangular panel sections comprising a handle forming section 18, adjoining sidewall forming sections 20 and 22 which are of equal size, a bottom wall forming section 23 and a relatively narrow connecting glue flap or panel 24 at the end of the blank which is opposite the panel section 20. The handle forming section 18 is subdivided by a fold forming transverse score line 25 which is parallel with and equidistant from the transverse score lines 14 and 15 and divides the section 18 into two equal size handle forming panels 26 and 27. Each of the handle forming panels 26 and 27 has a pair of generally rectangular cut-out areas 28 of identical configuration and size which are equally spaced from the transverse score line 25 and from score lines 14 and 15 in the respective panels. The cut-out areas 28 are located in transversely centered and in longitudinally paired alignment in the panels 26 and 27, so that, when the panels 26 and 27 are folded upon each other on the line 25, the paired apertures will align to form pairs of finger accommodating holes 30 in the double panel or double thickness handle formation 18 as shown in FIG. 1. Preferably, small hinged tab members 32 are formed by scoring on the lines 33 at the curved edge sides of the apertures 28 which tab members 32 reinforce or pad the edge areas for engagement by the fingers in grasping the carrier. The adjoining sidewall forming panels 20 and 22, which are of equal size, have cut therein pairs of bottle top receiving and gripping apertures 34. The apertures 34 are of truncated triangular configuration and of equal size, and they are equally spaced from a longitudinal center line a—a. Each of these apertures 34 has its shortest side 35 coinciding with the associated transverse score line 14 or 15, and upon folding the blank into the tube formation of FIG. 1, the apertures 34 in the panels 20 and 22 are in transversely aligned pairs, as shown in FIG. 1, and they are spaced according to the spacing of the bottles. The panel 23, which extends between score lines 16 and 17 and which constitutes the bottom panel of the set-up carrier, is provided with a pair of apertures 36 of identical configuration which are of a size and shape adapted to encompass the bottle adjacent the bottom of the neck area in snug relation and in spaced relation below the bottom edges 35 of the apertures 34. The apertures 36 are of generally circular configuration so as to engage a bottle having the same cross sectional configuration at the base of the neck where it is received in the aperture. Opposite side edge portions of the apertures 36 may be cut along the transverse score lines 16 and 17, as shown, so as to keep the width of the panel 23 to a minimum and facilitate application of the carrier to the bottles.

Figure 4:
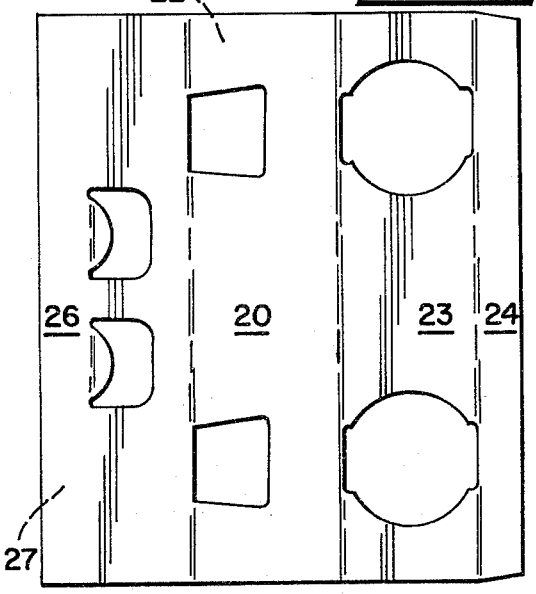
FIG. 4 is a plan view of the blank of FIG. 3 in partially folded and glued up condition in which it may be supplied to the bottling plant.

The blank 12, cut and scored as shown in FIG. 3, may be furnished to the bottle filling plant for folding and application directly to the bottles or the blank 12 may be initially folded on the score line 25 and the handle forming panels 26 and 27 secured in face-to-face relation as shown in FIG. 4. In applying the unfolded blank to a pair of bottles B, it is, of course, initially folded upon the score line 25 and the handle panels 26 and 27 are secured together, after which the setting up is completed by folding the sidewall panels 20, 22 and the bottom wall panel 23 into the triangular tubular arrangement or form shown in FIGS. 1 and 2 and gluing or otherwise securing the glue flap 24 to the lower margin of the sidewall panel 20, preferably on the inside face of the latter. As shown in FIG. 2, the carrier is adapted to be applied to a pair of bottles B which have an outwardly directed exterior flange formation F which is spaced somewhat below the bead or lip L at the base of the threaded mouth portion on which a screw cap C forms a closure. Current beverage bottles of the large size, which are formed of plastic, for example, are being supplied with flange formations F which are utilized in securing the carrier on the bottles. In the absence of the flange F the bottom of the lip formation L, which is common to all glass beverage bottles receiving cap closures, or the bottom edge of the cap skirt, would be utilized in the same manner, the apertures being located and the sidewalls being angled so as to engage the aperture edges beneath the lip or other protuberance adjacent the mouth of the bottle.

A modified form of the carrier is illustrated in FIGS. 5 to 7 which employs a rectangular blank 42 of a somewhat greater length than the blank 12. The blank 42 is cut and scored in the same manner as the blank 12 in FIG. 3, except as hereinafter noted. Where the elements are the same as in FIGS. 1 to 4, the same reference numerals are applied in FIGS. 5 to 7. The glue flap forming end panel 44 in the blank 42 has a somewhat greater dimension in the lengthwise direction of the blank than the end panel 24 in FIG. 3. This dimension in panel 44 corresponds approximately to the distance from the opposite end edge 45 of the blank 42 to the transverse edges 46 of the apertures 34 in the sidewall forming panel 20 so that when the carrier is set up the end edge 47 is positioned on a line with the aperture edges 46 and reinforces the latter by providing a double thickness of the edge material. The sidewall forming panel 22' which extends between the score lines 15 and 16 has the same overall dimensions as the panel 20 at the end of the blank and is provided with a pair of bottle top receiving apertures 34' of the same size and configuration as apertures 34 in panel 20. However, the transverse edge lines 46' are not cut but merely scored and a portion of the cut-out area, which would otherwise be waste, is utilized to provide edge reinforcing tabs 48 which are adapted to hinge on the score lines 46' into inside face engagement with the adjoining portions of the sidewall panel 22', as shown in FIG. 7, thereby reinforcing the weight bearing bottom edges of the apertures 34'. The bottom wall forming panel 43 has the same overall dimensions as the bottom wall forming panel 23 in FIG. 3 and is provided with a pair of transversely spaced apertures 36 in the same manner as in FIG. 3. However, the panel 43 is scored on the line 50 transversely of the blank and intermediate the transverse lines 16 and 17 so as to divide the panel 43 and enable the carrier to be completely formed in flattened condition with the two halves folded upon each other as shown in FIG. 6. The cut and scored blank is, of course, first folded on the line 50 and then folded on the line 25 with an application of glue or other appropriate securing means connecting the end margins of the blank and enabling the panels 20, 22' and 43 to be opened up so as to form the tubular shape shown in FIG. 7 for application to the bottles in the same manner as described with reference to the carrier in FIGS. 1 to 4. The reinforcing tabs 48 are initially folded on the score lines 46' and secured to adjoining areas of the sidewall panel 42 so as to be in edge reinforcing position when the panels are opened up for application to the bottles.

Figure 8:
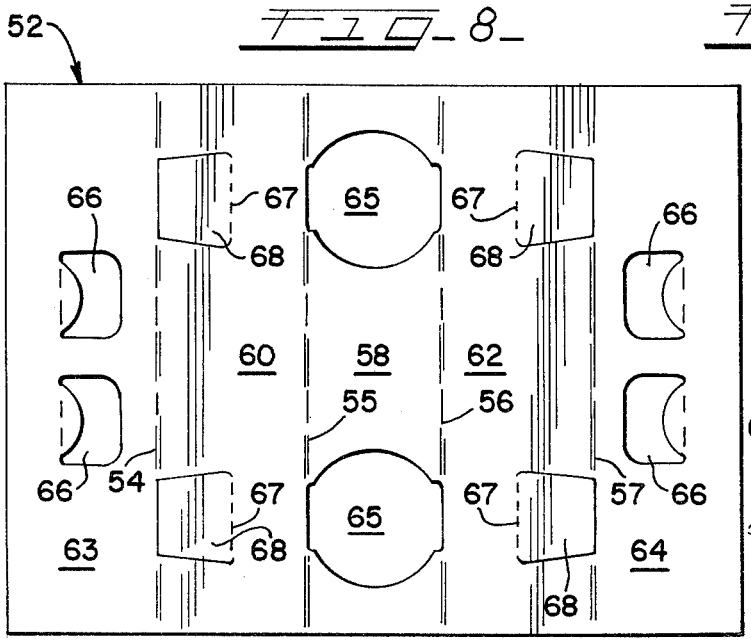
FIG. 8 is a plan view of a blank which is cut and scored preparatory to the forming of a further modified design of the carrier.
Figure 9:
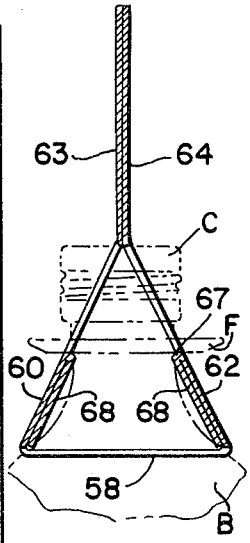
FIG. 9 is a cross-sectional view of the modified carrier formed with the blank of FIG. 8.

Another modified form of the carrier is illustrated in FIGS. 8 and 9 which employs a blank 52 of smaller length than the blank 12 for the carrier of FIGS. 1 to 4 and the blank 42 for the carrier of FIGS. 5 to 7. The transverse dimension of the blank 52 is the same as blanks 12 and 42 and the wall and handle panels have the small overall dimensions as the corresponding panels in blanks 12 and 42. The blank 52 is divided by parallel, longitudinally spaced transverse score lines 54, 55, 56, and 57 into a bottom wall forming center panel section 58, adjoining sidewall forming panel sections 60 and 62 and handle forming panel sections 63 and 64 which are at opposite ends of the blank. With this arrangement of the panels in the blank a connecting glue panel is not required. While the dimension of each of the panels in the direction longitudinally of the blank is approximately equal these dimensions will vary depending upon the size and configuration of the bottle. The center panel section is provided with a pair of bottle neck receiving apertures 65 corresponding to the apertures 36 in FIGS. 3 and 5. The handle forming end panels 63 and 64 are provided with finger accommodating apertures or holes 66 corresponding to finger holes 28 in FIGS. 4 and 5. The sidewall forming panels 60 and 62 are cut to provide pairs of bottle neck gripping apertures, of the same character as the holes 34 in FIG. 3. However, the material which is cut out completely in FIG. 3 to provide the apertures 34 is utilized in this form of the carrier by scoring on the transverse lines 67 so as to leave tabs 68 which fold or hinge on the score lines 67 so as to form a double thickness edge at the weight bearing fold line, as shown in FIG. 9, when the carrier is set up.

Figure 10:
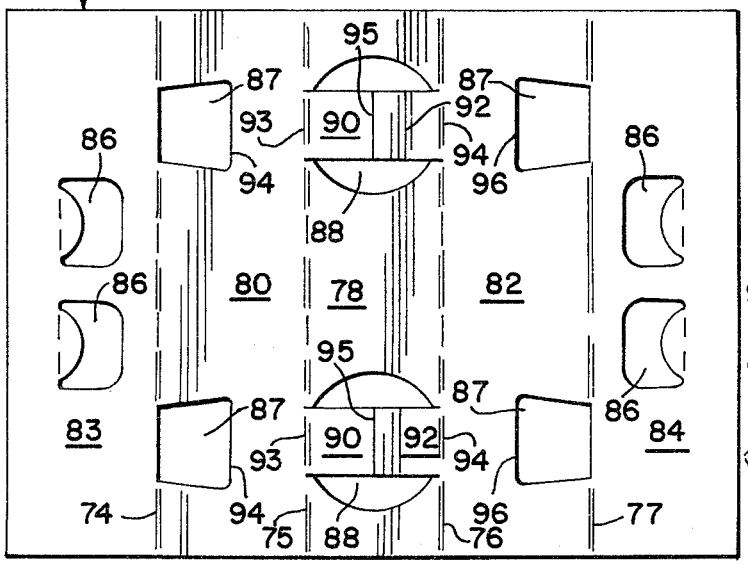
FIG. 10 is a plan view of a blank which is cut and scored preparatory to the forming of another modified design of the carrier.
Figure 11:
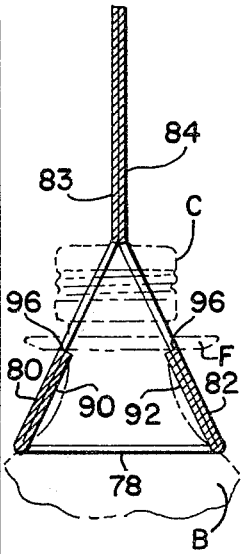
FIG. 11 is a cross-sectional view of the modified carrier which is formed with the blank of FIG. 10.

In the form of the carrier illustrated in FIGS. 10 and 11, which is basically the same as the carrier of FIGS. 8 and 9, the reenforcing tabs for the top gripping apertures in the sidewall panels are derived from a different area of the blank which otherwise would be wasted. The blank 72 in FIG. 10 is cut and scored in a manner similar to the blank 52 of FIG. 8 and may be the same size and shape. Spaced, parallel, transverse score lines 74, 75, 76, and 77 divide the blank 72 into a bottom wall forming center panel section 78, adjoining sidewall forming panel sections 80 and 82, and handle forming panel sections 83 and 84 at opposite ends of the blank. The handle forming panels 83 and 84 at opposite ends of the blank are provided with pairs of finger accommodating apertures 86 which correspond to the finger apertures 66 in the end panels 63 and 64 of the blank 52. The sidewall forming panels 80 and 82 are provided with pairs of bottle top receiving apertures 87 corresponding to the bottle top receiving and engaging apertures in the sidewall forming panels 60 and 62 of the blank 52 which result when the reenforcing tabs 68 are folded down (FIG. 9), except that the waste areas from which the tabs 68 are derived in the blank 52 are completely cut out in blank 72. The reenforcing for the bottom edges of the bottle top gripping apertures 87, in this form of the blank, is derived from blank areas which are wasted in forming the corresponding bottle neck accommodating apertures in the bottom wall forming panels in the blanks shown in FIGS. 3, 5, and 8. Each of the apertures 88 in FIG. 10 is cut so as to leave a pair of reenforcing tabs 90, 92 which are adapted to hinge on the transverse score lines 93, 94 which score lines 93, 94 coincide with the transverse hinge score lines 75 and 76, respectively. The panels 78, 80, 82 and the apertures 87 and 88 are dimensioned and arranged so that by cutting on the transverse center line 95 the tabs 90, 92 have a dimension in the longitudinal direction of the blank which equals the distance between the transverse score lines 75 and 76 and the cutting lines 96 which define the weight bearing bottom edges of the apertures 87. The carrier in this form, is set up and applied to the bottles in the same manner as the carrier of FIGS. 8 and 9 with the tabs 90, 92 being folded on the hinge lines 93 and 94 against the sidewall forming panels 80 and 82 so as to bring the edges defined by the cutting lines 95 into alignment with the aperture edges 96 as shown in FIG. 11.

An additional feature, which may be incorporated in the several forms of the carrier, for securing the handle panels, is illustrated in FIGS. 12 to 14. In this form, the carrier 100, which is illustrated in set up condition in FIG. 13, is formed from the blank 112, which is illustrated in FIG. 12. The blank 112 may be cut and scored in the same manner as shown in FIG. 10 so as to provide for forming the basic tubular arrangement and for reinforcing the weight bearing edges of the bottle top receiving and engaging apertures. Where the elements of blank 112 are the same as elements of blank 72 they are identified in FIGS. 12 to 14 by the same numerals primed. The blank 112 is divided by transverse, longitudinally spaced score or crease lines 74', 75', 76', and 77' into a bottom wall forming central panel 78', adjoining sidewall forming panels 80', 82' and handle forming panels 83', 84' at opposite ends of the blank. The central panel section 78' is cut and scored to provide the bottle neck receiving apertures 88' and associated reinforcing tabs 90', 92'. The adjoining sidewall forming panels 80' and 82' have bottle top engaging apertures 87' cut therein. The one handle forming panel 83' has cut therein a pair of finger accommodating apertures or holes 113 which are in transversely spaced and centered relation, with each of these apertures defined by a generally U-shaped cutting line 114 extending from the transverse score line 74' in the direction of the end edge 115 of the blank. Small finger engaging edge reenforcing tabs or pad members 116 are cut therein for hinging on the associated transverse score lines 117. The handle forming panel 84' at the opposite end of the blank 112 is cut and scored to provide a pair of cooperating finger accommodating apertures 118 (FIG. 13) which are located in the panel 84' so as to align with the apertures 113 in the panel 83' when the two panels are brought into face engagement to form the finger accommodating apertures shown in the handle arrangement 120 in FIG. 13. Each of the apertures 118 is formed by cutting on the transversely spaced lines 122, 123 which extend, longitudinally of the blank, from the transverse score line 77' in the direction of the end edge 124 of the blank, to a connection score line 125 at the outer ends of the lines 122 and 123. An outwardly bowed transverse cutting line 126 extends between intermediate portions of the cutting lines 122 and 123 which divides the material between these lines into a male locking tab 127 and an edge reenforcing tab or pad member 128, the former being adapted to hinge on the score line 77' and the latter being adapted to hinge on the score line 125. The locking tab 127 has small length cuts 130 extending inwardly of the edge lines 122 and 123 to enable the end portion 132 of the tab to be locked in a cooperating female aperture 133 formed by a U-shaped cut on the line 134 in the sidewall forming panel 80'. The panel 80' is provided with a pair of the female locking apertures 133 located in the panel in longitudinal alignment with the male locking tab elements 127 in the handle panel 84' so as to cooperate in locking the handle panels in position at the hinge lines 74' and 77'. The U-shaped cutting lines 134 face in the direction of the score line 74' and have a score line 135 connecting the free ends of the legs of the U so as to form a small latch or holding tab 136 for the male latch element 132 when it is folded over the bottom edge 137 of the aperture 113 and is inserted in the aperture 133 as shown in FIG. 13. The locking together of the two handle panels 83' and 84' in this fashion may be incorporated in any of the several forms of the carrier having the handle panels which are described herein.

Figure 15:
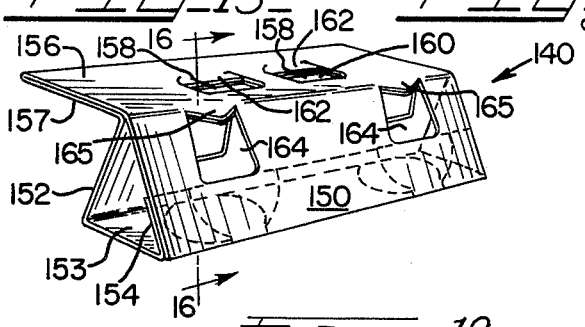
FIG. 15 is a perspective view of a modified form of the carrier of FIG. 1, the carrier being shown in the initial set-up condition as applied to the bottles.
Figure 16:
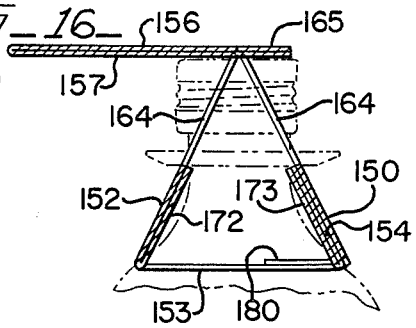
FIG. 16 is a cross-sectional view taken on the line 16—16 of FIG. 15.
Figure 19:
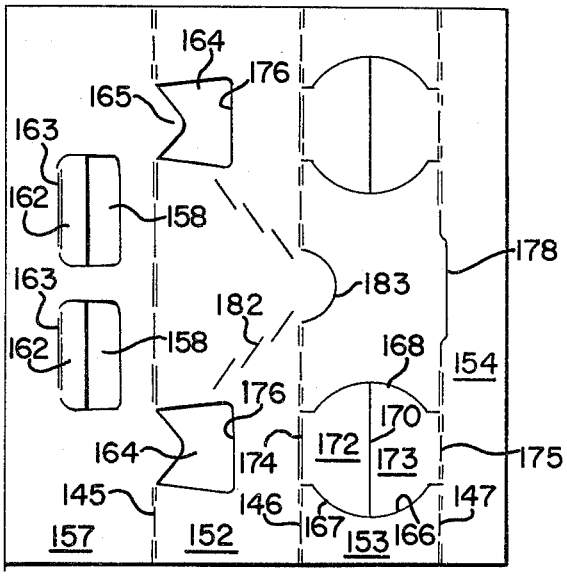
FIG. 19 is a plan view of the blank of FIG. 18 in partially folded and glued up condition in which it may be supplied for application to the bottles.
Figure 17:
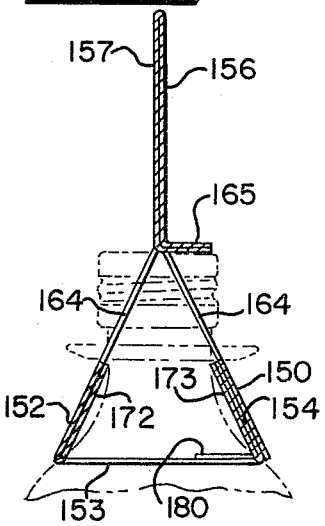
FIG. 17 is a cross-sectional view taken as in FIG. 16 with the handle portion in upright carrying position.
Figure 18:
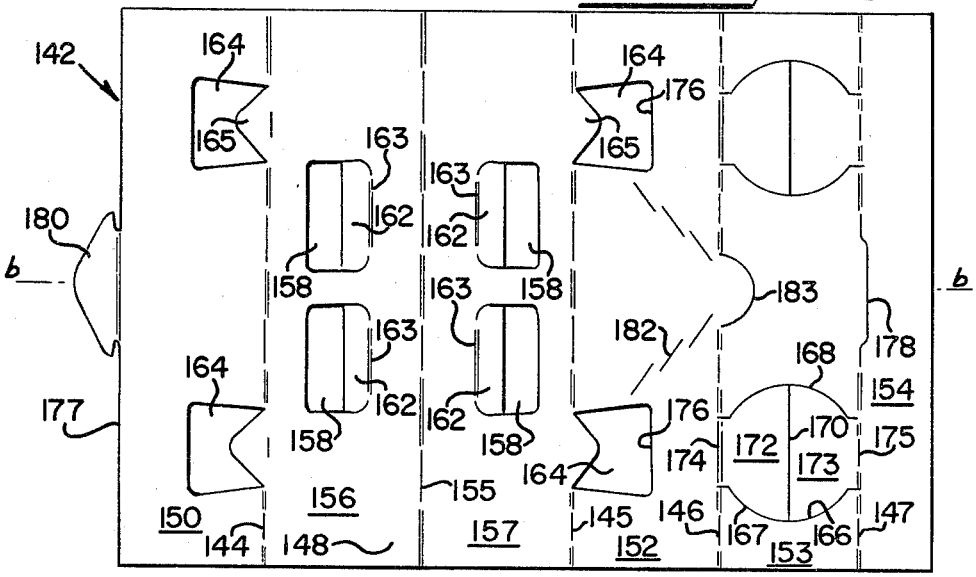
FIG. 18 is a plan view of a blank which is cut and scored for forming the carrier of FIG. 15.
Figure 20:
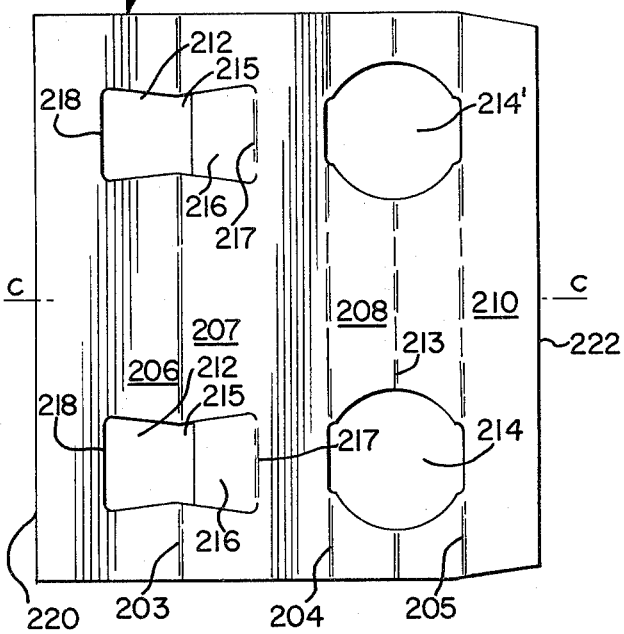
FIG. 20 is a plan view of a blank which is cut and scored preparatory to the forming of a carrier of abbreviated design which does not include a handle structure.
Figure 23:
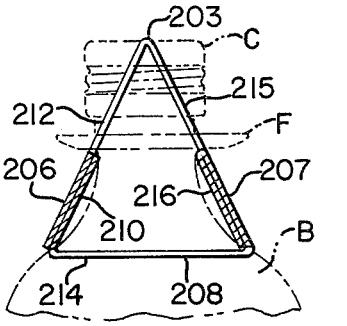
FIG. 23 is a cross sectional view taken on the line 22—22 of FIG. 21.
Figure 21:
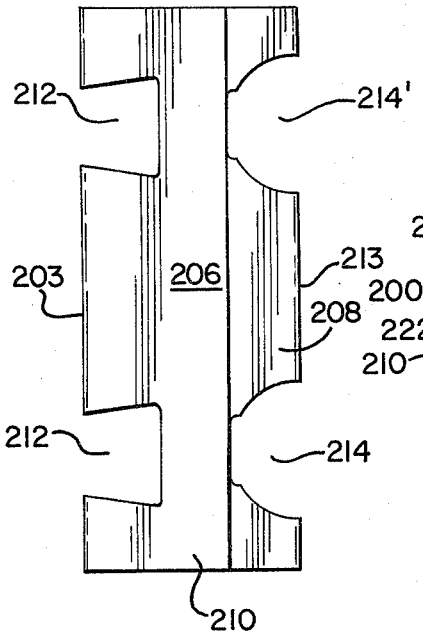
FIG. 21 is a plan view of the carrier formed with the blank of FIG. 20 in flattened condition.

In the form of the carrier 140 which is illustrated in FIGS. 15 to 19 a generally rectangular blank 142 of the board material is cut and scored or creased, as shown in FIG. 18, to provide the required panel members, bottle engaging apertures, panel folding hinge lines and connecting means which enable fabrication of the carrier 140 and its application to a pair of bottles. The blank 142 is generally rectangular and the basic arrangement corresponds to the arrangement for the two bottle carrier of FIG. 1. The blank 142 is divided by longitudinally spaced, parallel transverse score lines 144, 145, 146, and 147 into a series of integrally connected rectangular sections comprising a handle panel forming section 148, adjoining sidewall panel forming sections 150 and 152 which are of equal size, a bottom wall panel forming section 153 and a narrow wall panel connecting section 154 or glue panel at the end of the blank opposite the panel forming section 150. The handle forming section is subdivided by a fold forming transverse score or crease line 155 which is parallel with and equidistant from the transverse score lines 144 and 145 and divides the section 148 into two equal size handle panels 156 and 157 each of which has a pair of cut-out areas 158 or apertures corresponding to the finger accommodating cut-out areas or apertures 28 in FIG. 3. The cut-out areas 158, which are located in transversely centered and longitudinally paired alignment in the panels 156 and 157, are of identical configuration and size, and are equally spaced from the transverse score line 155 and from the score lines 144 and 145 in the respective panels. When the panels 156 and 157 are folded on the score line 155 the paired apertures 158 align to form a pair of finger accommodating holes 160 (FIG. 15) in the double thickness handle formation. Preferably, small tab members 162 are cut to extend in the apertures 158 with hinge score lines 163 for padding the edge areas engaged by the fingers in grasping the carrier. The adjoining sidewall forming panels 150 and 152 have cut therein pairs of bottle top receiving and gripping apertures 164 corresponding to the apertures 34 in FIG. 3. The apertures 164 are of truncated triangular configuration and of equal size, and they are equally spaced from a longitudinal center line b—b. The apertures 164 are cut so as to leave small triangular tab members 165 extending from the hinge-score lines 144 and 145, for a purpose hereinafter described. Each of the apertures 164 extends from the associated transverse score line 144 or 145 into the sidewall panel 150 or 152, in the direction of the blank end, so that, upon folding the blank into tube formation, the apertures 164 are in transversely aligned pairs and spaced according to the bottle spacing. The panel 153 which extends between the score lines 146 and 147 and which constitutes the bottom wall forming panel in the set-up carrier, is provided with a pair of bottle neck receiving apertures 166. The apertures 166 are generally circular and each is cut so that it is dimensioned and shaped to encompass a bottle adjacent the bottom of the neck, in snug relation, and in spaced relation below the bottle engaging bottom edge of the aperture 164. The apertures 166 are proportioned and cut so that the encompassing material, which would otherwise be wasted, may be utilized for reenforcing the bottle engaging edges of the apertures 166. The transversely spaced, semi-circular lines 167, 168 which define each of the apertures 166 extend between the transverse score lines 146 and 147 and the material between the same is divided, by a cut on the transverse line 170 into two equal reenforcing tabs 172 and 173 which are adapted to hinge on the portions 174 and 175 of the transverse score lines 146, 147 which extend between the ends of each pair of cutting lines 167, 168. The edge reenforcing tabs 172 and 173 are proportioned so that the dimension in the direction of the length of the blank corresponds substantially to the distance between the score line 146 and the bottle engaging edges 176 of the apertures 164. In the form shown the connecting panel 154 has a dimension in the direction of the length of the blank which substantially corresponds to the distance between the bottle engaging edges 176 of the apertures 164 in the sidewall panel 150 and the blank end edge 177, so that, when assembled or set up into a tube this panel serves also to reenforce the bottom edges 176 of the apertures 164 as shown in FIG. 16. The transverse score line 147 is interrupted near the center thereof and the material is cut on the line 178 which is offset a small distance into the connecting panel 154 so as to provide a female latching or locking slot for receiving an arrowhead type latching or locking finger member 180 which extends at the opposite end edge 177 of the blank. The one sidewall panel 152 is provided with a tear out arrangement which comprises a series of small cut lines 182 arranged in a V configuration with a finger gripping apex tab 183 cut into the panel 153.

The blank 142, cut and scored as shown in FIG. 18, may be folded on the score line 155 and the handle panels 156 and 157 secured together by a suitable adhesive or other fastening means prior to delivery for application to a pair of bottles. The paritally folded blank may be set up, in the form shown, and applied to the bottles with the handle panels in generally horizontal position, as shown in FIGS. 15 and 16, and retained in the turned down position by engagement of the tabs on the top surfaces of the bottle caps. In setting up the carrier and applying it to the bottles, the wall connecting panel 154 is hinged on the score line 147 to bring it into engagement with the inside face of the sidewall panel 150 where it may be secured by engaging the male latch element 180 in the cooperating female element 178. Alternatively, the latch elements may be omitted and other suitable securing means, such as, for example, a quick setting hot melt adhesive, may be employed. The packaging of a plurality of the carrier and bottle assemblies in a shipping carton is facilitated by the arrangement for retaining the handles in a horizontal position. The handle panel assembly may be readily swung to an upright carrying position as shown in FIG. 17 for removal from the shipping carton and subsequent handling. The panel 154 and the edge reenforcing tabs 172, 173 which are turned up upon positioning the carrier on the bottles, afford three thicknesses of the material in the areas of the one sidewall which engage the bottles. The connecting panel 154 may be narrowed and secured as in the carrier of FIG. 1 when single ply reenforcing of the aperture edges affords sufficient strength for supporting the bottles for which the carrier is designed.

Figure 22:
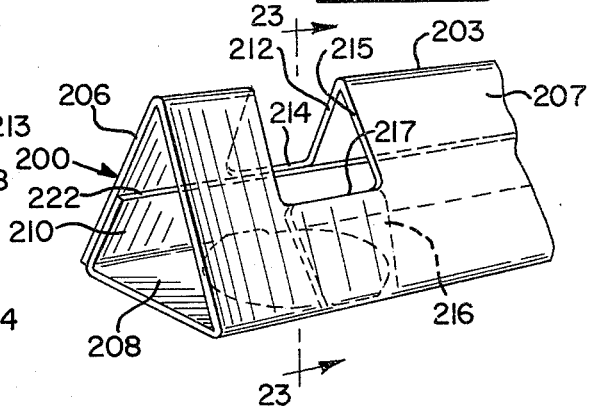
FIG. 22 is a perspective view of the carrier of FIG. 21 in set up condition.

An abbreviated form of the carrier which requires a minimum of material is illustrated in FIGS. 20 to 23 of the drawings. This form of the carrier, which is shown in set up condition at 200 in FIG. 22, employs a substantially smaller size blank 202 (FIG. 20) and is devoid of a handle structure, being adapted, when set up and applied to the bottles, to be grasp at a point between the bottles by positioning the fingers beneath the bottom wall forming panel. The rectangular blank 202 is divided by parallel hinge score lines 203, 204, and 205, into a pair of sidewall forming panels 206, 207 disposed in side-by-side relation, and adjoining bottom wall forming panel 208 and a connecting glue flap 210 which also serves as a reenforcement for the weight bearing edges of the bottle top receiving and gripping apertures 212 in the one sidewall forming panel 206. The bottom wall forming panel 208 is subdivided into two equal panel parts by a transverse score line 213 extending in parallel relation intermediate the score lines 204 and 205. A pair of bottle neck receiving apertures 214 are cut in the panel 218 in equally spaced relation on opposite sides of a center line c—c. The apertures 214 have the same configuration as the apertures 36 in the carrier of FIGS. 1 to 4 and are located so as to maintain the desired spacing between the pair of bottles. The two sidewall forming panels 206 and 207 have cut therein pairs of bottle top receiving and gripping apertures 212 and 215 which have the same configuration as the apertures 34 in the sidewall panels 20 and 42 in FIG. 5 but which are located on opposite sides of the score line 203, the latter constituting the connecting hinge line between the two sidewall panels 206 and 207. in the set-up form of the carrier (FIG. 22) the apertures 212 and 215 extend downwardly from the hinge line 203. Edge reenforcing tabs 216 are cut to hinge on the score lines 217 which define the bottom edges of the apertures 215. The connecting glue panel 210 has a width corresponding to the distance between the transverse cutting lines 218, which define the bottom edges of the apertures 212, and the end edge 220 of the blank, so that, when the blank is folded into set-up, tubular form, as shown in FIG. 22, the terminal edge 222 of the connecting glue panel 210 will align with the bottom edges defining the apertures 212 in the sidewall panel 206.

The handle structure in the form shown in FIGS. 15 to 19 may be incorporated in the other designs of the carrier device in which a handle is desirable. It facilitates the packing of the bottle units in a shipping container or carton and also facilitates palletizing and stacking by keeping the handle substantially even with the top edge of the assembly.

The weight bearing edge reenforcing may be incorporated in the carrier, as illustrated in the several forms thereof, when the weight of the article being carried warrants or requires it to avoid damage or failure at the bottle gripping points.

The embodiments of the invention in which an exclusive property or privilege is claimed are defined as follows:

1. A carrying member for articles in the form of bottles having a substantial neck portion depending from a cap receiving mouth formation, which neck portion has an annular projection which forms a downwardly facing abutment spaced below the bottom edge of the skirt of a closure cap on said mouth formation, said carrying member comprising a plurality of hingedly connected, generally rectangular panels of cut and scored sheet material which has substantial stiffness, said panels being folded and connected so as to form a tube of substantially triangular cross section, one of said panels constituting a bottom wall and having cut therein an aperture for positioning over the neck of an article and in a plane spaced a substantial distance below said abutment, a pair of said panels being hinged to opposite lateral edges of said bottom wall panel and constituting sidewall panels which extend upwardly from said bottom wall panel in converging relation to a top connecting hinge formation, said sidewall panels having laterally aligned apertures disposed therein with upwardly facing bottom edges positioned for engagement beneath said abutment at opposite sides of an article, said bottom edges of the aligned apertures in said upwardly converging sidewall panels disposed in gripping relation with the neck portion of the article in the area beneath said annular projection so as to support the weight of the article when carried, and said bottom edges of said apertures in said sidewall panels presenting a double thickness of material with at least one of said double thickness edges being formed by the terminal edge of a panel which has a hinged connection with said bottom wall panel and the associated sidewall forming panel and which is secured on the inside face of the bottom margin of said sidewall panel.

2. A carrying member for articles as set forth in claim 1 wherein said sidewall panels extend upwardly to a hinged connection with a handle forming panel structure and said bottom wall panel has an axial score enabling the tube to be collapsed into flattened condition.

3. A carrying member for articles as set forth in claim 1 wherein said sidewall panels are hingedly connected at the top edges to a pair of handle forming panels and said handle panels are secured in face engaging relation.

4. A carrying member for articles as set forth in claim 1 wherein said sidewall panels are hingedly connected along their top edges to a pair of handle forming panels and said handle panels having interengaging latch means securing said handle panels together in face engaging relation.

5. A carrying member for articles as set forth in claim 4 wherein said interengaging latch means comprises a bendable tab element on one of said handle panels, a cooperating aperture on the associated handle panel through which the tab may be swung and a tab locking aperture in the adjoining sidewall panel receiving said tab.

6. In a carrying member for articles as set forth in claim 4 wherein said interengaging latch means comprises a bendable latch element on one of said handle panels, a cooperating aperture on the associated handle panel through which said latch element may be swung and means for securing said latch element to said adjoining sidewall panel.

7. A packaging device for attachment to one or more articles having the form of a bottle with a neck portion depending from a mouth formation which is shaped to receive a closure cap spaced below the mouth thereof which device is formed from a cut and scored blank of foldable sheet material, said device comprising a plurality of hingedly connected generally rectangular panels which are folded into a tube with a generally triangular cross section, and which include a bottom wall forming panel having one or more apertures of a size and shape to encircle in snug engagement a bottom portion of an article neck in spaced relation below said abutment formation, sidewall forming panels hinged to opposite side edges of said bottom wall panel and extending upwardly therefrom in converging vertical planes to a hinged connection with a handle forming panel which may be positioned in a vertical plane for carrying or in a horizontal plane for stacking, said sidewall forming panels having cut therein pairs of oppositely disposed apertures which are spaced substantially above the level of said bottom wall forming panel, which are aligned vertically with an aperture in said bottom wall panel, and which are defined in part by double thickness bottom edge portions positioned to receive top portions of an article and engage in gripping relation beneath the abutment formation below the skirt of a cap on the mouth thereof.

8. A packaging device as set forth in claim 7 wherein said apertures in said sidewall panels extend to said hinged connection between the sidewall panels and said handle forming panel, and wherein said handle forming panel has tab members which extend from said hinged connection and project into said sidewall apertures, said tab members being positioned to engage on the top of an article so as to hold said handle panel in a horizontal plane when said device is initially attached to an article with the handle panel in said horizontal position.

9. A packaging device as set forth in claim 7 wherein each said bottom wall aperture has an edge reinforcing tab hinged on the hinge line connecting said bottom wall panel with a sidewall panel which tab is positioned, when the device is set up, against the inside face of the sidewall and extends to the bottom edge of the associated sidewall aperture.

10. A blank of foldable sheet material for forming a packaging device for articles in the form of bottles with a neck portion depending from a cap receiving mouth formation and having an abutment formation spaced below the mouth formation, which blank is generally rectangular and is cut and scored to provide a plurality of rectangular wall panels which are defined at least in part by hinge forming parallel transverse score lines and which comprise a bottom wall forming panel having cut therein one or more apertures of a size to fit snugly adjacent the bottom portion of the neck of an article when positioned thereon, a pair of sidewall forming panels having cut therein apertures which are each aligned with an aperture in said bottom wall panel and which have one edge coinciding with a score line separating said sidewall panel from an adjacent panel and an opposite edge spaced a predetermined distance from the score line defining the opposite edge of said sidewall panel, and a pair of handle forming panels each of which is separated by a hinge forming transverse score line from a sidewall panel, said bottom wall panel having an adjoining panel extending from the score line defining an edge thereof a distance corresponding to the distance between the edge of the aperture in the sidewall which is spaced from said opposite edge of said sidewall.

11. A blank of foldable sheet material as set forth in claim 10 wherein said bottom wall forming panel is disposed in the center of the blank, said pair of sidewall panels are disposed in integral relation along opposite side edges of said bottom wall panel and are separated therefrom by hinge score lines, and said handle forming panels are disposed at opposite ends of the blank.

12. A blank of foldable sheet material as set forth in claim 10 wherein said bottom wall forming panel is disposed adjacent one end of the blank and separated by a hinge score line from one of said pair of sidewall panels and said handle panels have integral tab formations extending from the hinge score lines separating the handle panels from the sidewall forming panels a short distance into the apertures in said sidewall forming panels.

13. A blank of foldable sheet material as set forth in claim 10 wherein said bottom wall forming panel is disposed adjacent one end of the blank and separated by a hinge score line from one of said pair of sidewall forming panels and wherein the other one of said pair of sidewall forming panels is disposed adjacent the opposite end of said blank and said sidewall forming panels are separated by a hinge score line.

* * * * *